United States Patent [19]

Young

[11] 4,085,851

[45] Apr. 25, 1978

[54] COATING FOR MULTI-WALL BAGS

[75] Inventor: Buck R. Young, Helena, Ark.

[73] Assignee: Hudson Pulp & Paper Corporation, New York, N.Y.

[21] Appl. No.: 569,656

[22] Filed: Apr. 21, 1975

Related U.S. Application Data

[63] Continuation of Ser. No. 213,513, Dec. 29, 1971, abandoned, which is a continuation-in-part of Ser. No. 776,506, Nov. 18, 1968, Pat. No. 3,642,697.

[51] Int. Cl.[2] ..... B65D 57/00

[52] U.S. Cl. ..... 214/10.5 R; 206/554; 229/53

[58] Field of Search ..... 214/10.5 R; 260/897 R; 229/53; 206/801

[56] References Cited

U.S. PATENT DOCUMENTS

| | | | |
|---|---|---|---|
| 2,784,131 | 3/1957 | Fletcher, Jr. | 214/10.5 R |
| 3,503,529 | 3/1970 | Brown | 214/10.5 R |

*Primary Examiner*—Frank E. Werner

*Attorney, Agent, or Firm*—Passquale A. Razzano; Harold L. Stults

[57] ABSTRACT

A plurality of bags filled with a product, which bags are to be stacked one upon the other so that the adjacent surfaces of the bags are pressed together by the weight of the upper bags pressing downwardly thereon, are coated with a coating means for controlling the friction between the coating means and the coextensive supporting surface of the adjacent bag. The coating means is adapted to become increasingly adhesive and cohesive when subjected to pressure, but with the cohesion and adhesion decreasing upon removal of the pressure so that the cohesion and adhesion between the supporting surfaces of the top two bags in the stack and the cohesion and adhesion between each pair of coextensive supporting surfaces is greater than the next pair above it by virtue of the increased weight of the product and the bag between them. As a result, the removal of the top bag in the stack produces a decrease in the cohesion and adhesion between the remaining bags in the stack.

4 Claims, 1 Drawing Figure

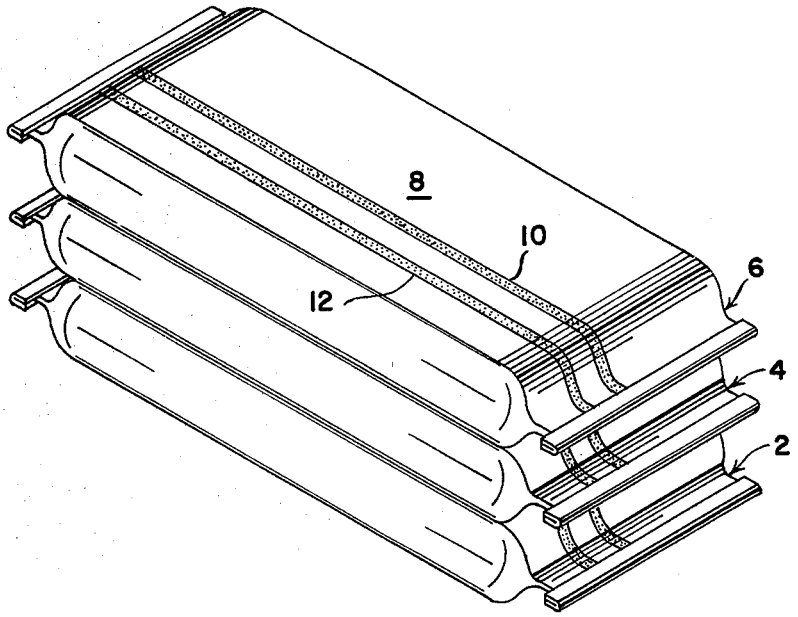
8
10
12
6
4
2

COATING FOR MULTI-WALL BAGS

This application is a continuation of U.S. patent application Ser. No. 213,513, filed Dec. 29, 1971, now abandoned, which was a continuation-in-part of U.S. patent application Ser. No. 776,506 filed Nov. 18, 1968 under 37 CFR 1.41(b), now U.S. Pat. No. 3,642,679, patented Feb. 15, 1972, the disclosure of which is incorporated herein by reference.

This invention relates to bags and particularly to coated paper bags of the type which are filled and stacked for storage for shipping.

An object of this invention is to provide multiwall bags having an improved "hot melt", anti-slip or anti-skid coating which are free of the difficulties which have been encountered in the past in stacking such bags. A further object is to provide multiwall bags with coatings of enhanced appearance and desirable, functional characteristics. A further object is to provide for the above with coating which may be applied efficiently and quickly and which may be varied to provide a range of friction characteristics. These and other objects will be in part obvious and in part pointed out below.

In the field of multiwall paper bags, it is common practice to stack filled bags for storage and shipment often employing a pallet as a platform therefor. Stacking of filled bags is an awkward process, subject to much inaccuracy, so exact balance and alignment of the bags is difficult. A bag is generally filled so that its thickness is of the order of one-third of its width. Packaging of different materials requires different bag sizes, if, for instance, uniformity of weight is desired. Stacked bags that are slightly unaligned or that are overfilled tend to shift due to vibration, movement or gradual drifting. As a result, a stack of bags may become severely unbalanced and may fall over. That result is particularly likely when a pallet of bags is being moved by a fork-lift truck or in a railroad car or truck.

Accordingly, it has been found to be desirable to either strap the bags together or to apply anti-skid or anti-slip coatings to the outer surfaces of the bags. Various of those coatings have not been fully satisfactory for a number of reasons, e.g. because they give the bag a generally dull and objectionable overall appearance and because they often chip, peel or flake, giving an unsightly appearance to the bags. Moreover, these coatings have a single cohesive or adhesive quality so that the bags are either tightly or loosely held together, depending on this adhesive quality, irrespective of their location in a stack. Thus, it is an object of this invention to overcome these problems by applying an adhesive coating to bags that has adhesive and cohesive qualities that vary according to the applied pressure so that the lower bags in a stack are secured together by greater binding forces than the bags at the top of the stack.

I have also found that by applying coatings of this nature to bags, the tendency for bags in a stack to slip or slide is reduced. That tendency is a function of the height and weight of the stack. Thus, the taller the stack, the more tendency there is for the bags forming the stack to slide. Thus, it is a further object of the invention to provide bags having a coating thereon which utilizes the height and weight of the stack formed by the bags to overcome the problems that the height and weight of the stack themselves produce.

In accordance with the invention, therefore, bags are treated with a coating having the characteristic that its adhesiveness and cohesiveness increase under increased pressure.

The single FIGURE shows an illustrative embodiment of the invention in the form of a stack of filled multiwall bags.

As seen in the drawing, three bags, 2, 4 and 6 are shown stacked one upon another, and each has an outer ply 8. Extending longitudinally and respectively on the top and bottom faces of each of the bags are two strips 10 and 12 of an anti-skid or anti-slide coating such as that described in my abovementioned U.S. patent, or a similar coating having the characteristics described below. In this embodiment, the two strips are offset toward the opposite side edges of the bags although they may be along the center of the side faces for example. Hence, with the bags stacked as shown in the drawing, or stacked in other patterns, each of the top and bottom exposed surfaces of the outer plys 8 presents a layer of the coating to the next adjacent bag above or beneath it.

Coating strips 10 and 12 have the characteristics of being substantially non-adhesive at normal ambient temperatures and when not subjected to pressure, but being heat-sensitive so as to become adhesive when heated, and pressure-sensitive so as to become adhesive when under pressure. Hence, when a bag is being handled by itself the coating strips do not exhibit adhesive characteristics and the bags can be handled and treated in the same manner as if there were no such coating. However, when one bag is stacked upon another, the pressure causes the coating to become somewhat adhesive and when a number of bags are stacked one upon another, the coating on the lowermost bags exhibits very substantial adhesive characteristics.

Accordingly, in a stack of bags such as shown in the drawing, the strip of coatings 10 and 12 on the bottom of the lower bag 2 exhibits substantial adhesion to the supporting surface; for example, a pallet or the floor in a truck or car. In a high stack of bags, those below the top one or two tend to adhere tenaciously to each other and the stack tends to behave in the manner it would if it were strapped together. The topmost bag 6 in the stack of the drawing has relatively little tendency to slide upon bag 4 beneath it because that tendency is a function of the weight of the material within bag 6. Bag 4, however, exhibits a pressure against bag 2 which is the total weight of bags 4 and 2; whereas bag 2 exerts a pressure on its supporting surface which is the total weight of bags 2, 4 and 6. On a pallet or in a truck or car where the bags are subjected to vibration and tipping actions tending to slide the bags one upon another, that tendency is a function of the weight and height of the stack. Hence, progressively downwardly from the top of the stack, there is an increasing tendency for the bags above a particular supporting surface to slide, but the increased weight also causes an increased adhesion. The characteristics of the coating may be controlled so that the increase in adhesion is sufficient to resist in a satisfactory manner the tendency for the bags to slide one upon another even in a relatively high stack.

In the illustrative embodiment, the coating is applied on one of the two major surfaces, such as shown in the drawing, generally three strips, although two strips or more than three may also be used. These strips may be continuous or discontinuous. Application is very easy, requiring only that the coating be heated, and also efficient, using less coating than would be necessary to cover the total outer surface of the bag. The coating may be relatively transparent, glossy, flexible and colorless, so that it does not impart an objectionable color or cast to the surface of a multiwall bag. More importantly, the coating components may be varied within certain, particular limits to obtain a desired degree of tack or slip characteristics as described in my prior patent application.

As mentioned before, the coating may be glossy; hence, it can be used to enhance the appearance of the surface to which it is applied. For instance, by coordinating the pattern in which it is applied with the printing on the bag, an attractive graphic effect can be achieved. The coating is relatively transparent, glossy, flexible and colorless, so that it does not impart an objectionable color or cast to the surface of a multi-wall bag. More importantly, the coating components may be varied within certain, particular limits to obtain a desired degree of tack or slip characteristics.

The coating is a particular blend of thermoplastic materials which give a glossy, flexible film with adjustable tack to provide for resistance to sliding at slide angles within the range from 25° to 60°. The slide angle is determined by inclining a stack of loaded bags, on a pallet either in a three-bag or five-bag pattern, and observing the smallest angle to the horizontal at which slippage occurs.

To form the coating, two parts by weights of a polyolefin resin or a copolymer thereof are blended with three parts of tackifying resin. Thereafter, an amount of plasticizer is added, the amount being that which will provide the desired slide angle characteristic. The finished product will have ingredients in the following percentage ranges:

TABLE I

| | Composition range of components in percent by weight |
|---|---|
| Polymer | 30–40 |
| Tackifying resin | 50–60 |
| Plasticizer | 0–20 |

For the purposes of the invention, the percent ranges of these constituents are important. Thus, if the polymer content is raised and the tackifier content lowered, the coating approaches an ordinary hot melt barrier coating; whereas if the tackifier content is raised or the plasticizer content increased beyond the upper limit, the material becomes a pressure-sensitive adhesive.

As the olefin polymer, 30 to 100 melt index, low density polyethylene or any polyolefin such as polypropylene or copolymer thereof having the equivalent melt viscosity and elastomeric quality are suitable. These materials are readily available and are sold under a variety of names.

As tackifiers, pale refined rosins or terpene resins may be used. Synthetic resins are based on rosins, terpenes or cu-marone-indene are equally suitable. These materials are readily available under a variety of names. For example, Wing Tack-95 is a terpene-like hydrocarbon resin available from Goodyear Tire & Rubber Co.; Staybelite, a hydrogenated rosin, is a suitable tackifier and available from Hercules Chemical Co. as well as another suitable material which is a refined rosin derivative sold under the trade name Polypale.

Plasticizers useful in the present combination are white mineral oil, safflower oil, or a dialkyl ester of phthalic acid or adipic acid such as dibutyl adipate or dioctyl phthalate, i.e. esters derived from alcohols of 3 to 18 carbon atoms, preferably 3 to 10 carbon atoms.

Generally, the mineral oil employed is of medium to heavy weight and the properties for this type of oil are as follows:

TABLE II

| | Medium to heavy |
|---|---|
| Specific gravity, gms./cc | 0.84–0.92 |
| Specific gravity, ° Be. at 60° F. | 24–28 |
| Boiling Point, ° F. | Above 500 |
| Flash Point, ° F. | Above 400 |
| Viscosity, Saybolt, sec. at 100° F. | 250–450 |

Again, the coating can be tailored from the desired slide angle by varying the plasticizer content. In Table III to follow, various amounts of plasticizer are employed in the coating composition disclosed herein. The anti-slip properties of the present combination are illustrated in FIGS. 2 and 3 herein.

TABLE III.

ANTISLIP COATING WITH VARYING AMOUNT OF PLASTICIZER

| | Components in parts by weight | | | |
|---|---|---|---|---|
| Polyethylene[1] | 40 | 40 | 40 | 40 |
| Tackifying resin, Wing Tack-95[2] | 60 | 60 | 60 | 60 |
| Heavy mineral oil, plasticizer | 5 | 10 | 15 | 20 |
| Total | 105 | 110 | 115 | 120 |

[1]Melt index 70, density 0.912.
[2]Wing Tack-95 is a hydrocarbon resin obtainable from Goodyear Tire & Rubber Co.

It has been found that coating can vary from 5 to 25 lb./ream, preferably from 10 to 15 lb./ream in the coated area, the coating being of the order of one-half mil. Although thicker coatings may be employed, these do not offer any practical advantages.

The coating may be applied to the bags in strips varying in width according to needs, for example from one and a half to three inches. It has been found that coating can vary from 5 to 25 lb/ream, preferably from 10 to 15 lb/ream in the coated area, the coating being of one mil or less in thickness with the minimum being of the order of one-half mil. Although thicker coatings may be employed, these do not offer any practical advantages.

It is to be understood that while the coated strips have been disclosed as being placed longitudinally of the bags, the strips can also be placed, if desired, transversely to the bags without destroying the anti-slide capabilities.

What is claimed is:

1. A plurality of bags filled with a product and stacked one upon another and each having first and second opposite surfaces with each said first surface being a supporting surface which is substantially co-extensive with the second surface of the next adjacent bag and said surfaces being pressed together by the weight of each upper bag pressing downwardly onto the bag beneath it, at least one of said surfaces on each of said bags having anti-slip coating means thereon for producing variable adhesion for controlling the friction between the coating means and the co-extensive surface of the next adjacent bag, said coating means comprising means for increasing adhesion and cohesion between said coating means and said next adjacent surface as the pressure to which they are subjected increases and for decreasing the cohesion and adhesion upon removal of said pressure, whereby the cohesion and adhesion between the supporting surfaces of the top two bags is minimum and the cohesion and adhesion between each other pair of co-extensive surfaces is greater than the next adjacent pair above it because of the increased pressure resulting from the weight of the product in the bag between them, and whereby the removal of the top bag in the stack produces a decrease in said cohesion and adhesion between the remaining of said co-extensive surfaces in the stack, said means for increasing and decreasing cohesion comprising a composition of low density polypropylene or polyethylene polymer, a tackifying resin and a plasticizer.

2. A plurality of bags as described in claim 1 wherein each bag is a multiwall bag with an outer ply of paper presenting rectangular surfaces between the two ends of the bag, said coating being formed on the upper surface of each bag in stripped form between the ends of the bag.

3. A plurality of bags as described in claim 2 wherein said coating in stripped form comprises a pair of strips upon each supporting surface of each bag with the strips upon the two surfaces being offset from the vertical center plane of the bag.

4. A plurality of bags filled with a product and stacked upon one another and each having two opposite supporting surfaces with at least one of the supporting surfaces of each bag being co-extensive with a supporting surface of the next adjacent bag and said surfaces being pressed together by the weight of each upper bag pressing downwardly onto the bag beneath it, at least one of said supporting surfaces of each bag having an anti-slip coating means thereon which produces variable adhesion for controlling the friction between the coating and the co-extensive supporting surface of the next adjacent bag and for increasing cohesion and adhesion therebetween when subjected to increasing pressure whereby the cohesion and adhesion between the supporting surfaces of the top two bags is minimum and the cohesion between each pair of co-extensive supporting surfaces is greater than the next adjacent pair above it because of the increased pressure resulting from the weight of the product in the bag between them; said means for increasing and decreasing cohesion comprising a composition of low density polypropylene or polyethylene polymer, a tackifying resin, and a plasticizer.

* * * * *